US005230559A

United States Patent [19]

Porter et al.

[11] Patent Number: 5,230,559

[45] Date of Patent: Jul. 27, 1993

[54] WELL LIGHT

[75] Inventors: David Porter, Chagrin Falls; Thomas A. Garber, Hudson, both of Ohio

[73] Assignee: The L.D. Kichler Co., Cleveland, Ohio

[21] Appl. No.: 814,993

[22] Filed: Jan. 8, 1992

[51] Int. Cl.[5] ..... E01F 9/00

[52] U.S. Cl. ..... 362/153.1; 362/285; 362/396; 362/418

[58] Field of Search ..... 362/418, 153.1, 183, 362/285, 286, 287, 372, 382, 396

[56] References Cited

U.S. PATENT DOCUMENTS

| | | | |
|---|---|---|---|
| 3,519,811 | 7/1970 | Jacobs | 362/372 |
| 4,180,850 | 12/1979 | Bivens | 362/285 |
| 4,310,875 | 1/1982 | Price | 362/287 |
| 4,399,494 | 8/1983 | Perkins | 362/190 |
| 4,638,970 | 1/1987 | Phelan | 362/418 |
| 4,974,134 | 11/1990 | Bourne | 362/286 |
| 4,984,139 | 1/1991 | Goggia | 362/153.1 |
| 5,003,441 | 3/1991 | Crowe et al. | 362/183 |

*Primary Examiner*—James C. Yeung

*Attorney, Agent, or Firm*—Watts, Hoffmann, Fisher & Heinke

[57] ABSTRACT

A lighting apparatus is disclosed which includes a lighting source suspended inside a cylindrical housing. The light source is connected to a device for suspending the light source within the housing such that the housing can be removed from the housing by lifting the device and disengaging it from the housing. The light source may be suspended inside the housing in varying configurations to provide different illumination patterns.

6 Claims, 6 Drawing Sheets

WELL LIGHT

BACKGROUND OF THE INVENTION

1. Field of the Invention

The present invention relates to outdoor lighting fixtures, and more particularly, to outdoor lighting fixtures which have adjustable illumination patterns.

2. Description of the Related Art

The use of outdoor lighting fixtures has become popular for illuminating buildings, gardens, pathways and entrance ways. Landscape architects frequently use partially buried outdoor well lights for illuminating trees and shrubs, and for providing silhouettes and shadowing effects.

Existing well lights have been found deficient in durability, versatility, adjustability, and ease of maintenance. Existing well lights are typically limited in their ability to vary the illumination pattern. Often, the light source is limited to a few degrees of pivotal motion. Typically, existing well lights require that screws or other fasteners be removed to replace the light bulb. Since the lights are exposed to the weather, the fasteners often become corroded making bulb replacement difficult. Existing well lights are also susceptible to breakage from lawn mower wheels among other things.

SUMMARY OF THE INVENTION

Basically, the lighting fixture comprises a housing well having an outlet end, a light source, and apparatus removably suspending the light source within the well. The suspending apparatus has a weight supporting portion supporting the weight of said light source from said well so that said light source can be removed from said outlet end by disengaging said weight supporting portion from the housing well.

BRIEF DESCRIPTION OF THE DRAWINGS

A preferred embodiment of the invention is shown in the accompanying drawings in which.

DESCRIPTION OF THE PREFERRED EMBODIMENT

Figure 1:
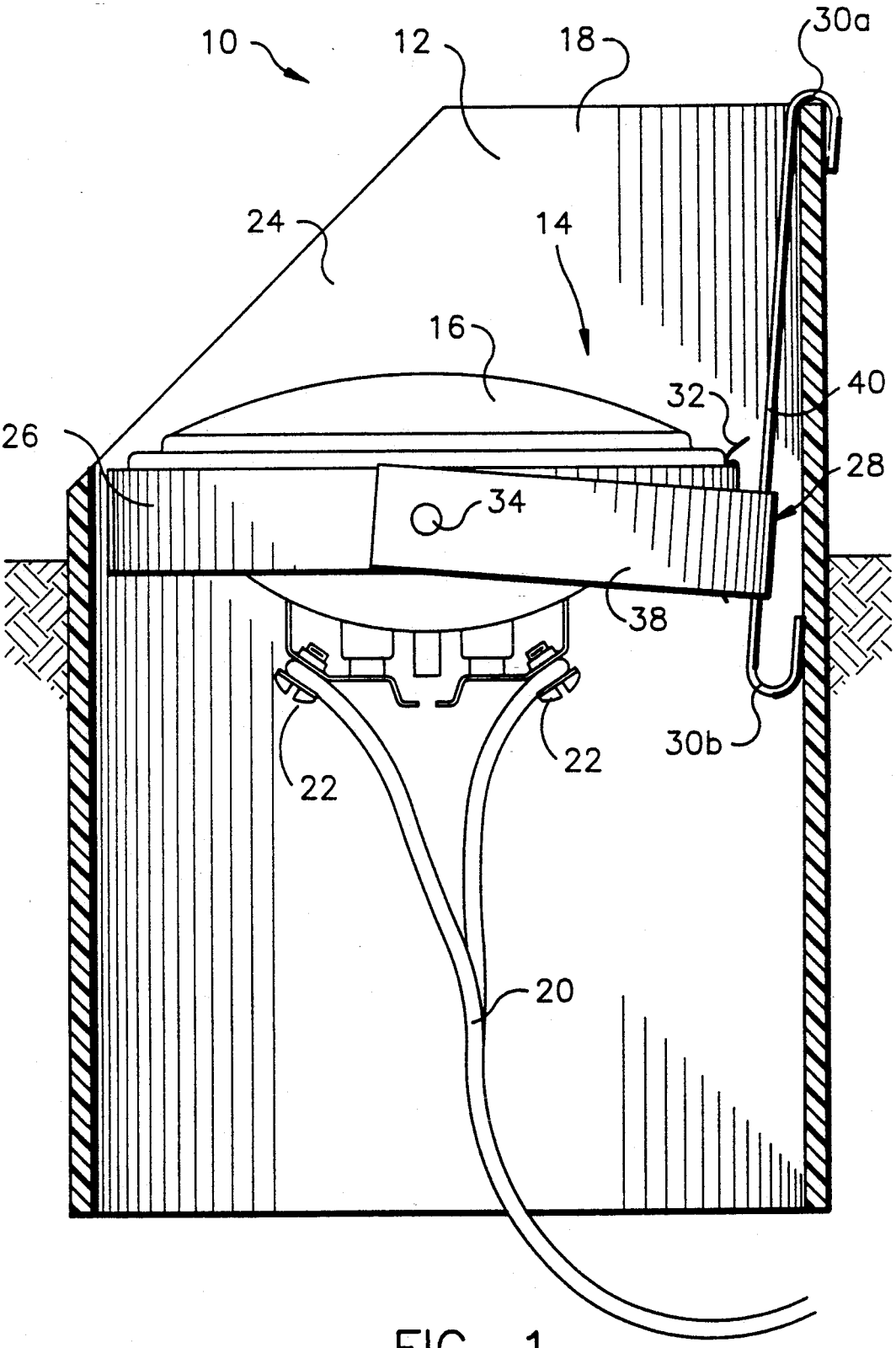
FIG. 1 is a side elevation view, partly in cross section, of a well light constructed in accordance with the present invention.

The well light 10 embodying the present invention includes a housing well 12, a suspension fixture 14 which is adjustably supported inside the housing well 12, and a light bulb 16. The housing well 12 is partially buried in the ground with one end exposed as an outlet 18 for the light. Power is supplied to the light bulb 16 by wires 20 connected to a set of terminals 22.

Figure 2:
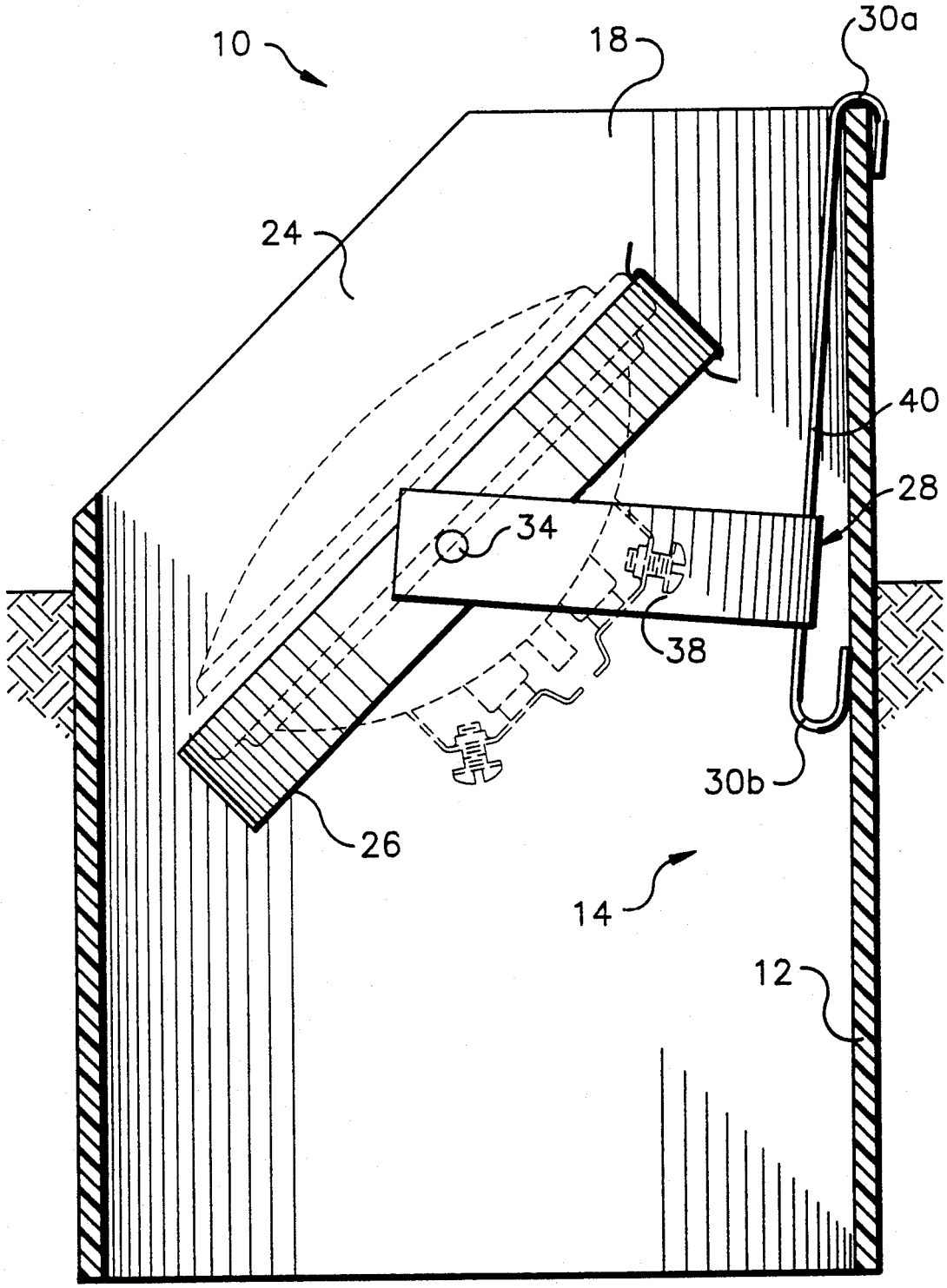
FIG. 2 is a side elevation view, partly in cross section, of the light of FIG. 1 in a different position.
Figure 3:
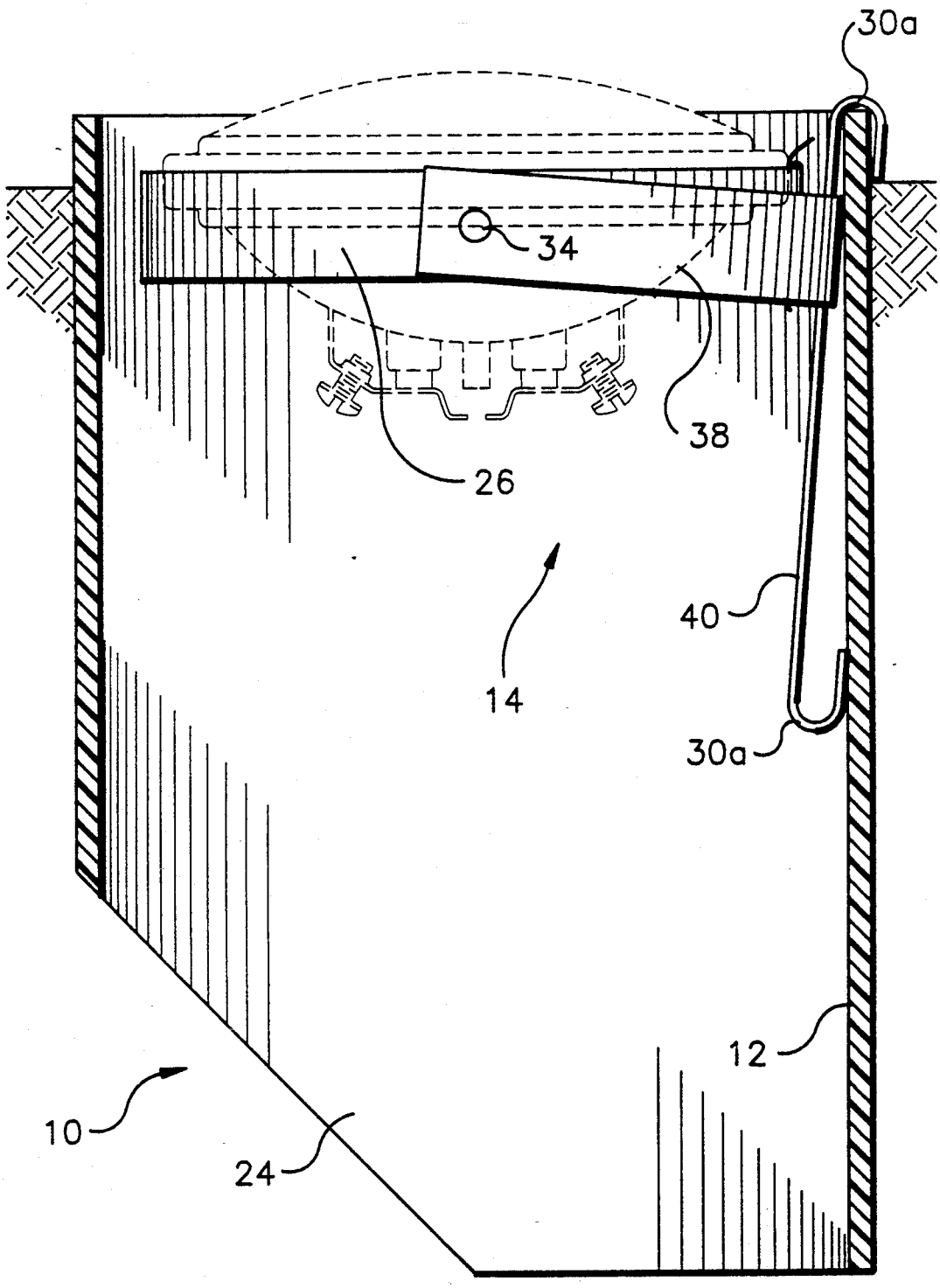
FIG. 3 is a side elevation view, partly in cross section, of the well light of FIG. 1 in a different configuration.
Figure 4:
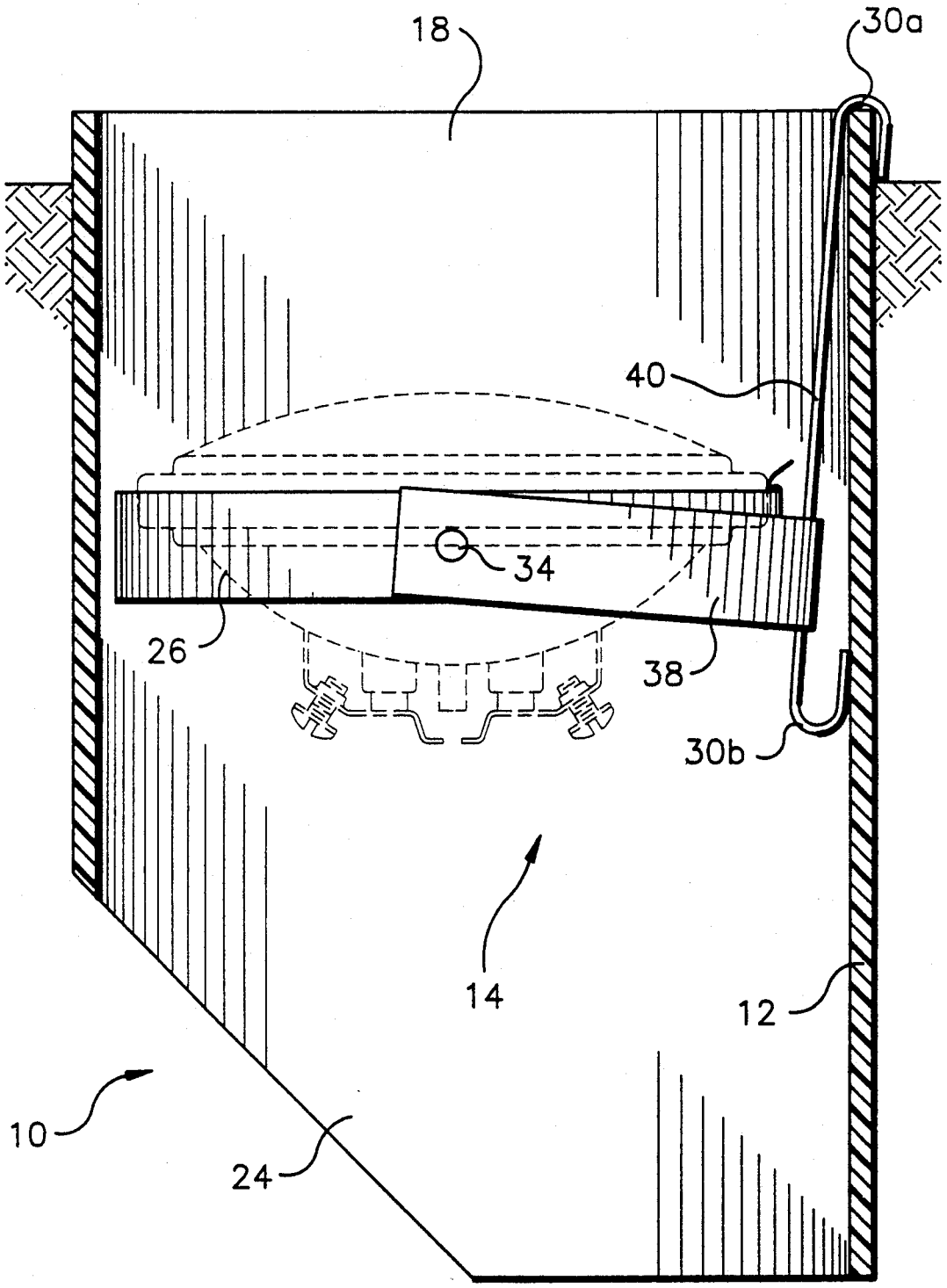
FIG. 4 is a side elevation view, partly in cross section, of the well light of FIG. 1 in a different configuration.

The housing 12 comprises a high-strength polyethylene cylinder. The cylinder is cut-away on one side to provide a lateral opening 24 for light. Thus, if it is desired to provide a lateral beam of light, the cut-away end may be used as the light outlet end 18 as shown in FIGS. 1 and 2. If desired, the cut-away end may be buried in the ground as shown in FIGS. 3 and 4 and the opposite end may be used as the outlet 18. The high-strength polyethylene housing 12 serves to house and protect the light bulb 16 from breakage.

The suspension fixture 14 comprises a light bulb retainer ring 26 and a hanger member 28 connected to the retainer ring 26. The fixture 14 is suspended inside the housing 12 by a weight-supporting member or hook **30*a* on the hanger member 28 and is readily removable for bulb replacement. The bulb 16 and fixture 14 can be removed from the outlet end 18 of the housing well 10 by disengaging the hook 30*a* from the edge of the housing well 12 and lifting. The fixture 14 may be hung from either of two hooks 30*a*, 30*b* depending on the desired lighting pattern. One hook 30*a* suspends the bulb lower in the housing well than the second hook 30*b* as seen in FIGS. 1, 2, and 4**.

Figure 5:
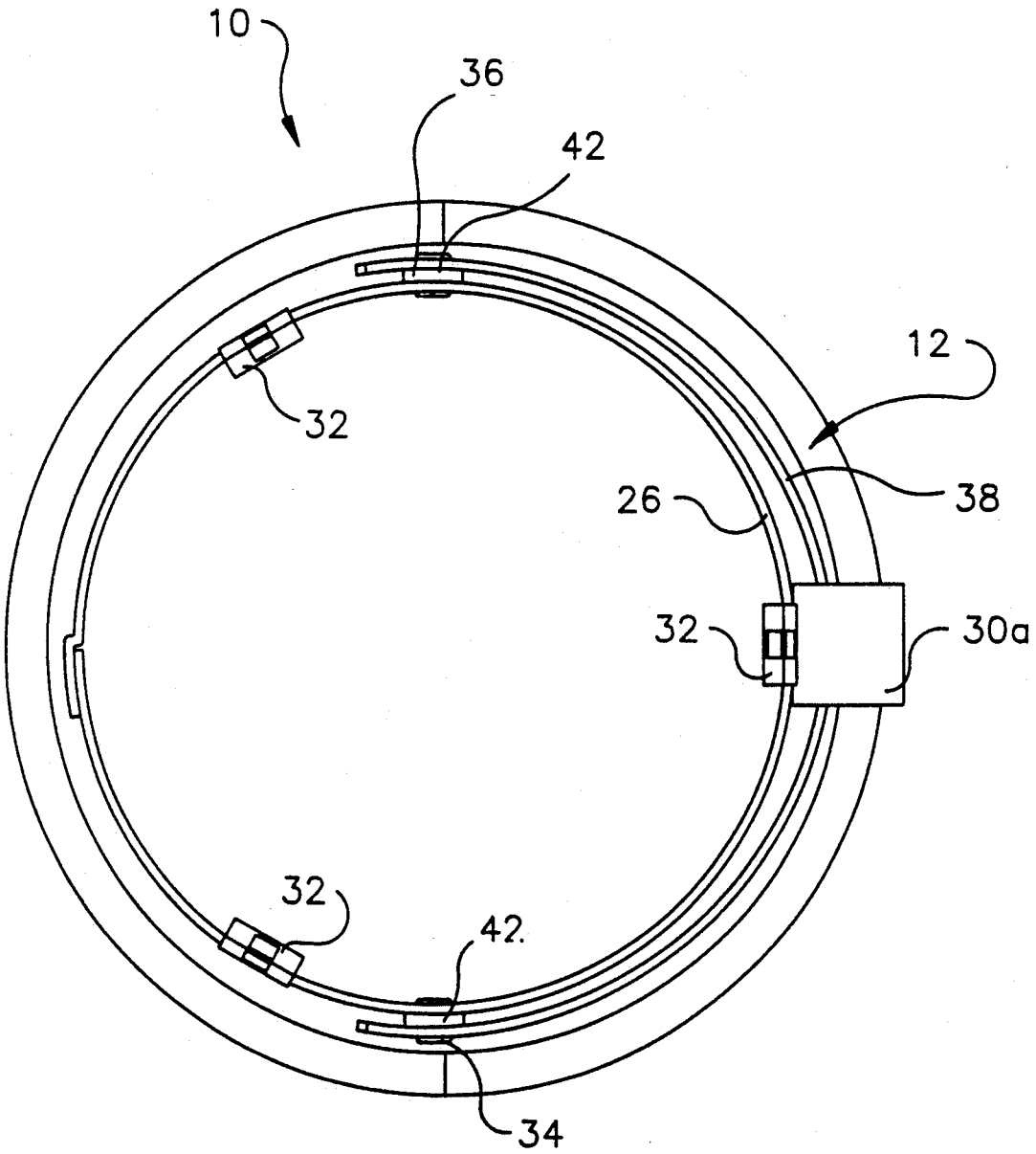
FIG. 5 is a plan view as seen approximately from the plane indicated by line 5—5 in FIG. 1.
Figure 6:
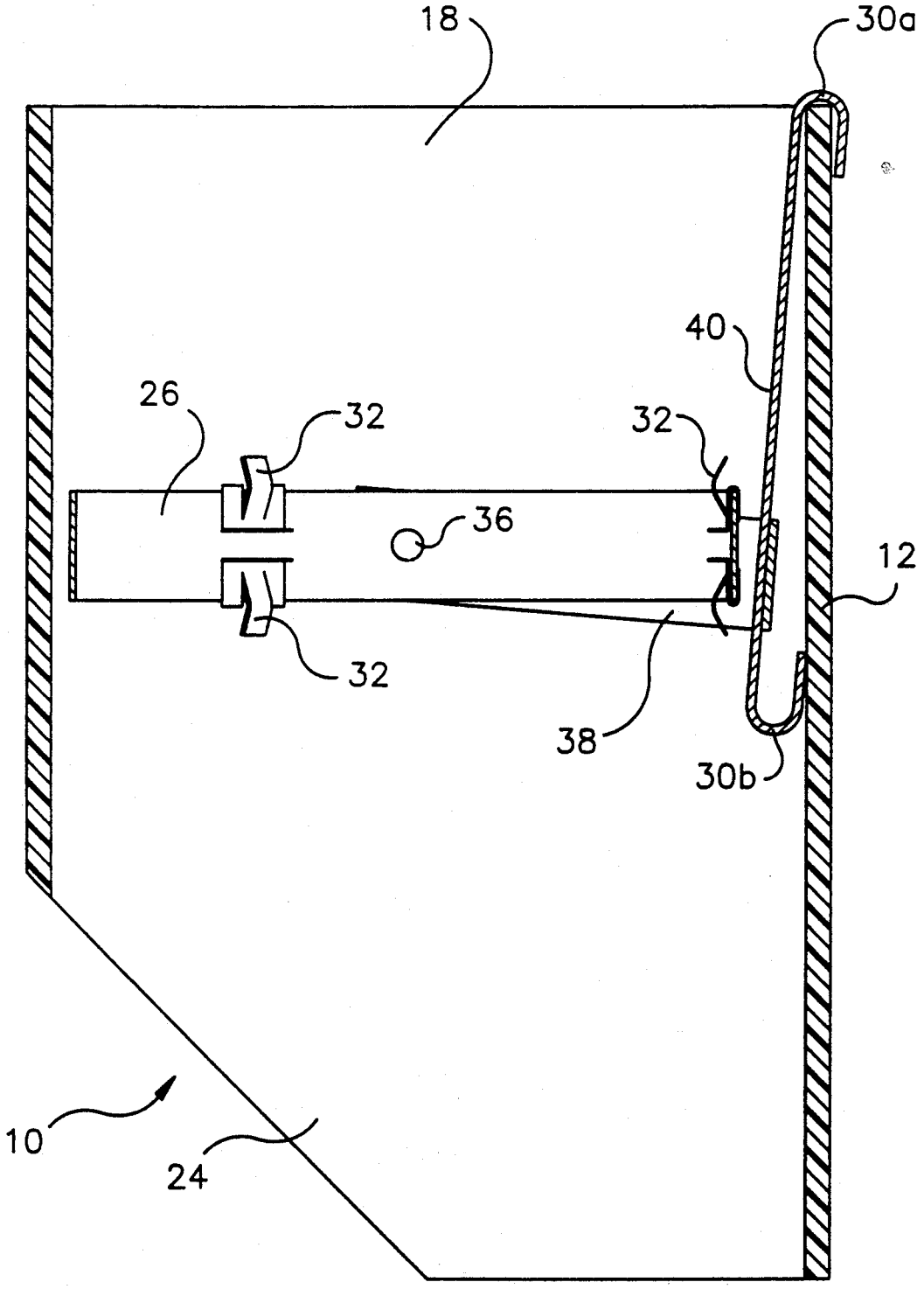
FIG. 6 is a side elevation view in full cross section with the bulb removed.

The retainer ring 26 is preferably stainless steel. A plurality of retainer clips 32 are attached to the ring 26 to retain the bulb 16 within the ring 26. The clips 32 apply a spring force to the bulb 16 to hold it within the ring 26. The retainer clips 32 permit the bulb 16 to be readily released. Manual application of pressure to one side of the bulb causes the peripheral edge of the bulb 16 to slide past the retainer clips 32. The ring 26 is pivotally connected to the hanger member 28 by a pair of pivot joints 34, 36 as best seen in FIG. 5.

The hanger member 28 comprises a semi-circular stainless steel member 38 and a hook member 40 fixed thereto. The semi-circular member 38 is pivotally connected to the ring 26 at the pivot joints 34, 36. Elastomeric washers 42 are placed between the ring 26 and the semi-circular member 38 at each pivot joint 34, 36.

The hook member 40 comprises a stainless steel strap having the first and second hooks **30*a*, 30*b* formed at its respective ends. The hook member 40 is connected to the middle of the semi-circular member 38 at a point which is closer to one hook 30*b* than the other 30*a*. Each hook 30*a*, 30*b* is adapted to engage the edge of the housing well 12 to suspend the fixture 14 within the housing well 12 as shown in FIGS. 1–6. The bulb 16 and ring 26 are rotated to aim the light toward the outlet 18 regardless of which hook 30*a*, 30*b* is being used. Thus, one way of changing the lighting pattern is to remove the fixture 14 from the housing 12, rotate the ring 26 about the axis of the pivot joints 34, 36 approximately 180 degrees, invert the fixture 14, and re-hook it to the housing 12 from the opposite hook. The lighting pattern is narrowed by positioning the fixture deeper in the housing well and broadened by positioning it nearer to the outlet 18**.

The well light 10 constructed according to the invention is corrosion resistant and durable as a result of the stainless steel fixture 14 and the polyethylene housing 12. The light is versatile and readily adjustable due to the suspension fixture 14 configuration. In addition, the parts are simple and easy to construct at low cost.

While a preferred embodiment of this invention has been described in detail, it will be apparent that certain modifications or alterations can be made without departing from the spirit and scope of the invention as set forth in the appended claims.

We claim:

1. A lighting apparatus comprising:

a) an electric light source;

b) a housing having a tubular wall and an outlet end through which light from said source may pass;

c) a light supporting structure for suspending said light source within said housing, said structure including a member having first and second ends, said ends having first and second hooks, respectively, for engaging the wall of said housing at said outlet end, wherein said source is connected to said member at a location closer to one of said hooks than the other by a predetermined distance such that the location of the light source within the housing may be selectively varied between a first depth when said first hook is chosen to suspend the source and a second depth when said second hook is chosen to suspend said source.

2. A light apparatus as claimed in claim 1 wherein said light source is pivotally connected to said member such that it may be rotated to cast light in the direction of the outlet end regardless of which hook is chosen to suspend the source.

3. A lighting apparatus as claimed in claim 1 wherein said outlet end includes a sidewall opening for casting light in a lateral direction.

4. An outdoor lighting apparatus comprising:

a) an electric light source;

b) a housing having a tubular wall and an outlet end through which light from said source may pass, said housing being adapted to rest partially buried in the ground with its longitudinal axis in a generally vertical position;

c) a light supporting structure for removably suspending said light source within said housing, said structure including a member having first and second ends, said ends having first and second hooks, respectively, for engaging the wall of said housing at said outlet end, wherein said source is pivotally connected to said member at a location closer to one of said hooks than the other by a predetermined distance such that the location of the light source within the housing may be selectively varied between a first depth when said first hook is chosen to suspend the source and a second depth when said second hook is chosen to suspend said source and wherein said light supporting structure is inverted when its suspension is changed from one hook to the other.

5. A lighting apparatus as claimed in claim 4 wherein said light source may be pivoted about said pivotal connection to cast light in the direction of the outlet end regardless of which hook is chosen to suspend the source.

6. A lighting apparatus as claimed in claim 5 wherein said outlet end includes a sidewall opening for casting light in a lateral direction.

* * * * *